US006874703B2

(12) United States Patent
Gottemoller et al.

(10) Patent No.: US 6,874,703 B2
(45) Date of Patent: Apr. 5, 2005

(54) ANTI-BOUNCE NEEDLE VALVE FOR A FUEL INJECTOR

(75) Inventors: Paul Gottemoller, Palos Park, IL (US); Michael Barry Goetzke, Orland Park, IL (US)

(73) Assignee: General Motors Corporation, Detroit, MI (US)

( * ) Notice: Subject to any disclaimer, the term of this patent is extended or adjusted under 35 U.S.C. 154(b) by 165 days.

(21) Appl. No.: 10/166,885

(22) Filed: Jun. 11, 2002

(65) Prior Publication Data

US 2003/0226911 A1 Dec. 11, 2003

(51) Int. Cl.[7] ..... F02M 59/00
(52) U.S. Cl. ..... 239/533.2; 239/88; 251/129.01
(58) Field of Search ..... 239/533.2, 585.1, 239/88; 251/129.1

(56) References Cited

U.S. PATENT DOCUMENTS

| | | | | | |
|---|---|---|---|---|---|
| 4,417,693 | A | * | 11/1983 | Fussner et al. | 239/453 |
| 4,662,338 | A | * | 5/1987 | Itoh et al. | 123/467 |
| 4,706,788 | A | * | 11/1987 | Inman et al. | 188/378 |
| 5,284,302 | A | | 2/1994 | Kato et al. | |
| 5,427,352 | A | * | 6/1995 | Brehm | 251/64 |
| 5,636,827 | A | * | 6/1997 | Kilgore et al. | 251/129.01 |
| 5,803,370 | A | * | 9/1998 | Heinz et al. | 239/533.9 |
| 5,901,685 | A | * | 5/1999 | Noyce et al. | 123/467 |
| 6,311,582 | B1 | | 11/2001 | Chow | |

FOREIGN PATENT DOCUMENTS

| | | | |
|---|---|---|---|
| DE | 3314899 | A1 | 10/1984 |
| DE | 4332117 | A1 | 3/1995 |
| DE | 10060290 | A1 | 6/2002 |
| JP | 05-272434 | * | 10/1993 |
| WO | WO96/09473 | | 3/1996 |

* cited by examiner

*Primary Examiner*—Dinh Q. Nguyen
(74) *Attorney, Agent, or Firm*—Cary W. Brooks

(57) ABSTRACT

An anti-bounce needle valve for a fuel injector, wherein the needle inherently incorporates the anti-bounce feature. The needle has a conventionally configured exterior for interfacing with a valve seat and a tip body of a conventional fuel injector. The needle is characterized by a needle body having an interior cavity which is filled with small diameter shot, preferably generally spherical tungsten carbide shot. In operation, when the needle impacts upon the valve seat at the conclusion of a fuel injection process, the shot causes the needle collision with the valve seat to be inelastic, thereby eliminating needle bounce.

3 Claims, 2 Drawing Sheets

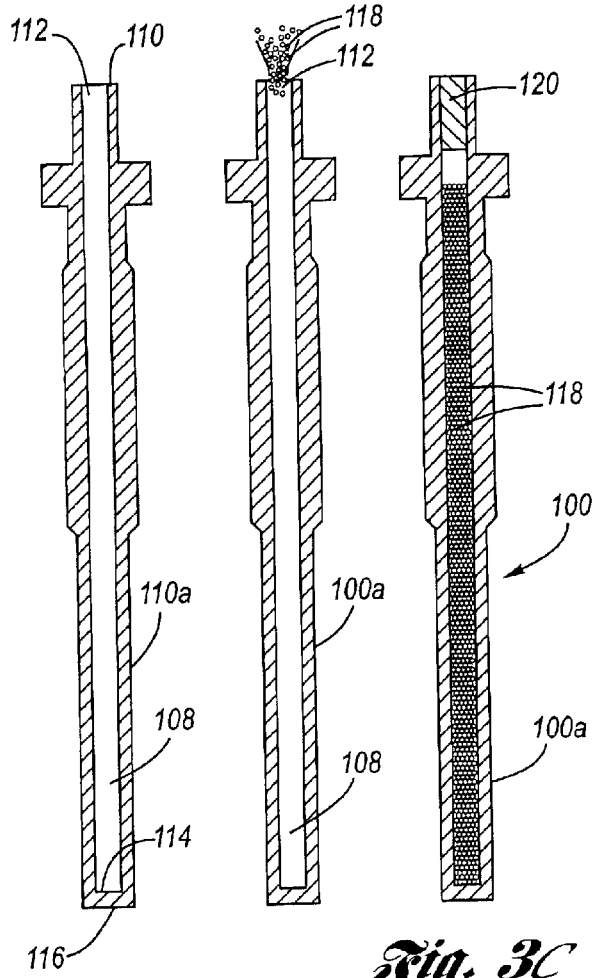
Fig. 3A
Fig. 3B
Fig. 3C
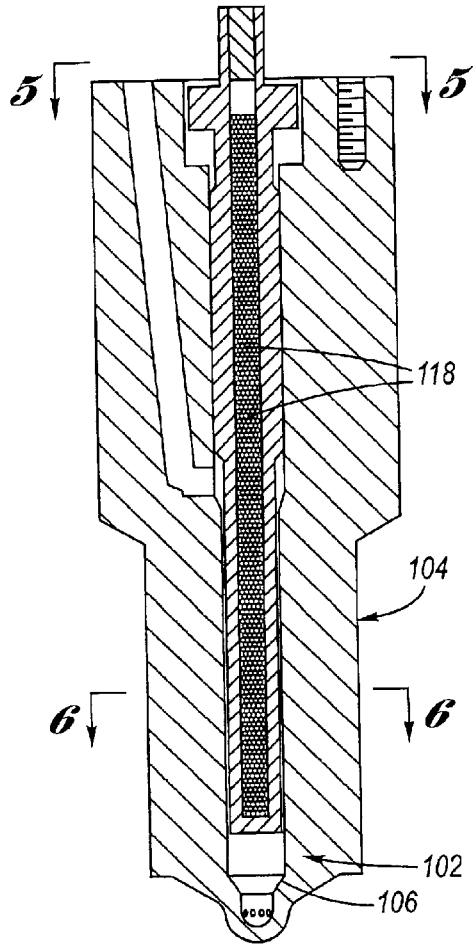
Fig. 4
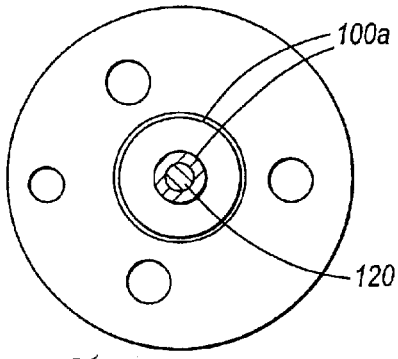
Fig. 5
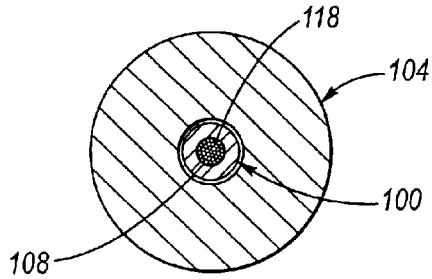
Fig. 6

ANTI-BOUNCE NEEDLE VALVE FOR A FUEL INJECTOR

TECHNICAL FIELD

The present invention relates to fuel injectors used for internal combustion engines, and more particularly to the needle valve thereof. Still more particularly, the present invention relates to a needle valve of the aforesaid type having an anti-bounce feature.

BACKGROUND OF THE INVENTION

Internal combustion engines, particularly diesel engines, utilize fuel injection systems for providing precise metering of fuel to each cylinder, thereby enhancing performance and fuel economy, as well as reduction of undesirable emissions.

A typical conventional application of a fuel injector 10 with respect to a diesel internal combustion engine 12 is shown at FIGS. 1 and 2. A source of pressurized fuel 14 is connected by a fuel line 16 to the fuel injector 10. As best seen at FIG. 2, the fuel injector 10 includes a tip body 18, a needle valve 20 including a needle 22 and valve seat 24, and a needle spring 26 which biases the needle seatably upon the valve seat. Pressurized fuel passes along a passage 28 of the fuel injector and upon a predetermined level of pressure being attained, the needle 22 moves against the biasing of the needle spring 26, thereby opening the needle valve seat 20, whereby fuel injects into the cylinder. When the pressurized fuel drops below a second predetermined level, the needle 22 is biased by the needle spring 26 so as to again close the needle valve 20. The movements of the needle 22 are very rapid, and when the needle closes upon the valve seat 24, a percussion occurs.

Engine performance, fuel economy and emissions all depend upon precise timing of the start and end of the fuel injection event. In this regard, it is desirable for the beginning and end of the fuel injection event to be as rapid as possible.

The closure percussion involves a tendency of the needle 22 to bounce at the valve seat 24, with the undesirable consequences of undue seat wear and a second fuel injection occurring during the bounce. The bounce induced fuel injection involves an unwanted low pressure fuel injection late in the combustion cycle which can adversely affect fuel economy and performance and increase undesirable emissions.

The origin of closure percussion bounce relates to the metallic components of the needle and the valve seat colliding in an essentially elastic manner. As such, there is a substantial conservation of kinetic energy which translates into bounce of the needle.

Conventionally, fuel injector manufacturers have struggled with needle bounce, and have attempted to solve this problem by incorporating hydraulic assist systems which serve to assuage needle bounce. Problematically, these hydraulic systems are complex and costly.

Accordingly, what is needed is a fuel injector needle valve in which the needle valve inherently has an absence of bounce.

SUMMARY OF THE INVENTION

The present invention is an anti-bounce needle for use in a needle valve of a fuel injector, wherein the anti-bounce needle inherently incorporates the anti-bounce feature.

The anti-bounce needle according to the present invention has a conventionally configured exterior for interfacing with a valve seat of the needle valve with the tip body of a conventional fuel injector. The anti-bounce needle is characterized by a needle body having an interior cavity which is filled with small diameter shot, preferably generally spherical tungsten carbide shot.

In operation, when the anti-bounce needle impacts upon the valve seat at the conclusion of a fuel injection process, the shot causes the needle collision with the valve seat to be inelastic, thereby rendering the kinetic energy of the impact to be non-conserved (transformed to heat) such that no bouncing of the needle with respect to the valve seat can occur.

Accordingly, it is an object of the present invention to provide an anti-bounce needle of a needle valve for a fuel injector.

This and additional objects, features and advantages of the present invention will become clearer from the following specification of a preferred embodiment.

BRIEF DESCRIPTION OF THE DRAWINGS

FIG. 3A is a sectional view of an anti-bounce needle according to the present invention at a first stage of fabrication.

FIG. 3B is a sectional view of an anti-bounce needle according to the present invention at an intermediate stage of fabrication.

FIG. 3C is a sectional view of an anti-bounce needle according to the present invention at a final stage of fabrication.

FIG. 4 is a partly sectional side view of an anti-bounce needle according to the present invention shown seated in a tip body of a conventional fuel injector.

FIG. 5 is a partly sectional view seen along line 5—5 in FIG. 4.

FIG. 6 is a partly sectional view seen along line 6—6 in FIG. 4.

DESCRIPTION OF THE PREFERRED EMBODIMENT

Figure 1:
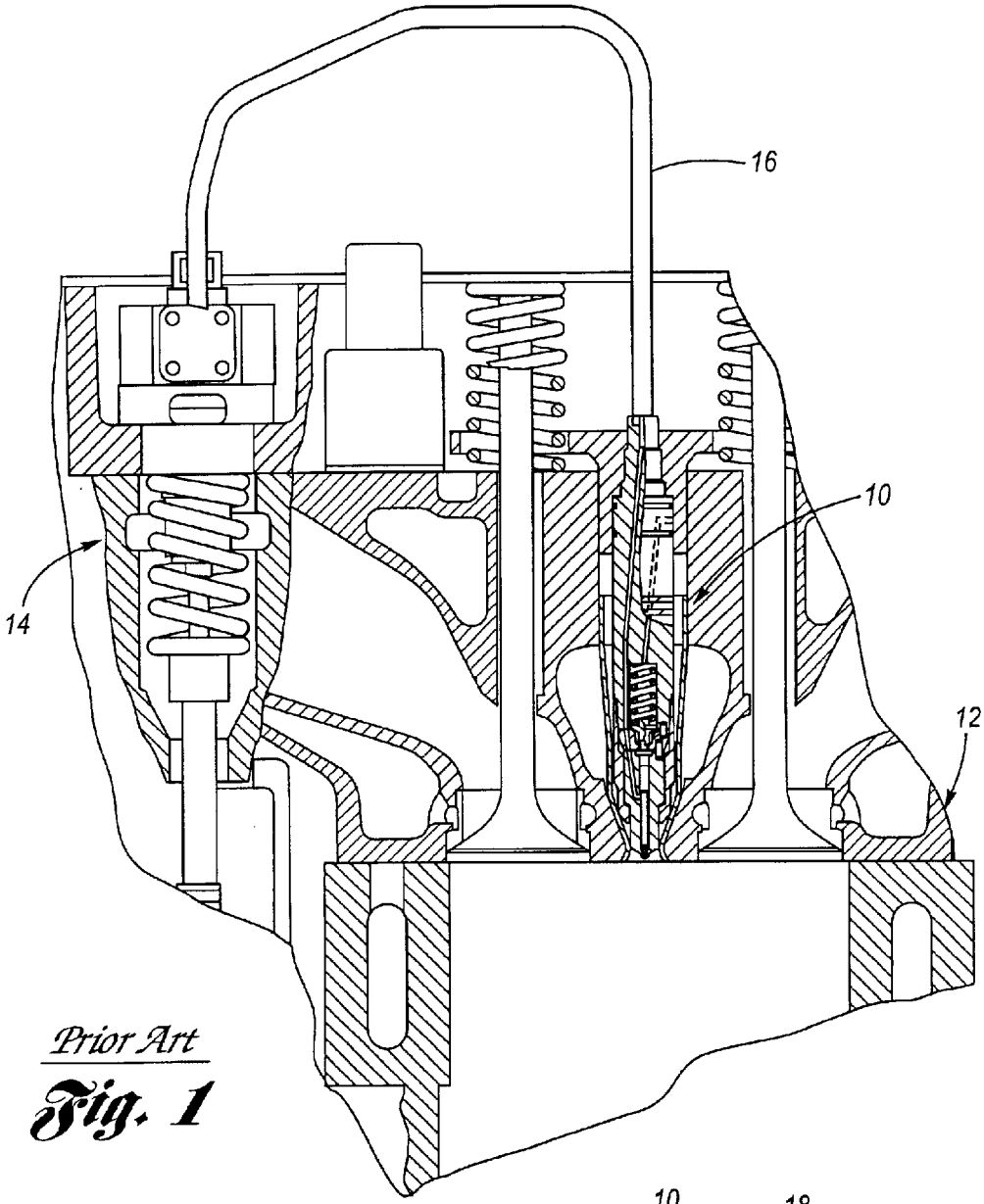
Prior Art Fig. 1
FIG. 1 is a broken-away, partly sectional side view of a diesel engine having a conventional fuel injector.
Figure 2:
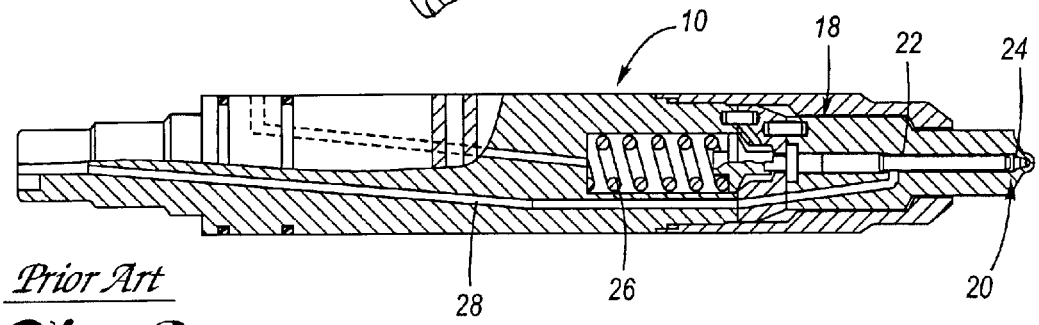
Prior Art Fig. 2
FIG. 2 is a sectional side view of the conventional fuel injector of FIG. 1.

Referring now to the drawings, FIGS. 3A through 6 depict an example of an anti-bounce needle 100 for a needle valve 102 of a fuel injector of an internal combustion engine. The anti-bounce needle 100 is configured as appropriate for usage in a fuel injector tip body 104 with respect to a valve seat 106 thereof. For example, the anti-bounce needle 100 is composed of a material, and is externally configured, per that of a conventional needle.

As shown at FIG. 3A, the anti-bounce needle 100 has a needle body 100*a* having an interior cavity 108 formed therein, as for example by boring or other fabrication technique. The interior cavity 108 runs from the aft end 110 of the anti-bounce needle 100, whereat is formed an opening 112, and terminates in a blind end 114 at the fore end 116 of the anti-bounce needle (the fore end of the needle interfaces with the needle seat).

As shown at FIG. 3B, a multiplicity of loose shot 118 is introduced fillingly into the interior cavity 108 via the opening 112 thereof. The shot 118 is preferably tungsten carbide shot having a small radius (for example, the shot may have a radius of about an order of magnitude smaller than the diameter of the anti-bounce needle).

As shown at FIG. 3C, a plug 120 is placed in the interior cavity 108 at the aft end 110 of the needle 100. The plug 120 is fixed securely and immovably to the anti-bounce needle 100, as for example by a press-fit, adhesive or weld. Upon placement of the plug 120, the shot fills at least a substantial portion of the interior cavity such as to be loosely distributed inside.

As shown at FIG. 4, after fabrication, the anti-bounce needle 100 is fitted into the fuel injector tip body 104, wherein the anti-bounce needle seats with respect to the valve seat 106.

In operation, when the anti-bounce needle impacts upon the valve seat at the conclusion of a fuel injection process, the shot 118 causes the needle collision with the valve seat to be inelastic such that there is no bounce of the anti-bounce needle.

It is believed that the underlying principle of operation is as follows. Although momentum is conserved in any collision, the kinetic energy need not be conserved. Consider a moving object and a target object which is immovable. In a perfectly elastic collision, kinetic energy is conserved so that upon collision, the moving object bounces off the target object. On the other hand, if the collision is perfectly inelastic, upon collision, the moving object will stop at the target object and not bounce. Generally, for any collision, the energy terms may be represented by:

$$KE_1=KE_2+Q$$

wherein $KE_1$ is the kinetic energy ($\frac{1}{2}m(v_1)^2$) of a moving object (the anti-bounce needle) before collision with an immovable target object (the valve seat), $KE_2$ is the kinetic energy ($\frac{1}{2}m(v_2)^2$) of the moving object (the anti-bounce needle) after collision with the immovable target object (the valve seat), and Q is an amount of heat (and sound energy) generated by the collision.

In a conventional fuel injector needle collision with its valve seat, the collision is generally elastic such that Q is small, and since the valve seat is immovable, $V_2$ is large and must be damped by bounce into the spring and/or a conventional hydraulic assist system. However, in the anti-bounce needle according to the present invention, the change of momentum of the shot is spread out over time such that the collision is substantially inelastic, wherein Q is large and $V_2$ is vanishing such that there is no bounce of the needle. This principle of operation is similar to that employed by dead blow hammers.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A fuel injector, comprising:

a fuel injector tip body;

a valve seat formed in said tip body; and an anti-bounce needle located in said tip body, said anti-bounce needle having a fore end and an oppositely disposed aft end, said anti-bounce needle comprising:

a needle body having an interior cavity extending generally from said aft end to said fore end; and a multiplicity of shot filling substantially all of said interior cavity such that said shot is loosely distributed in said interior cavity.

2. The fuel injector of claim 1, wherein said shot is composed of tungsten carbide.

3. The fuel injector of claim 2, wherein said shot is generally small diametered compared to a diameter of said interior cavity.

* * * * *